US007266332B2

(12) United States Patent
Watanabe et al.

(10) Patent No.: US 7,266,332 B2
(45) Date of Patent: Sep. 4, 2007

(54) IMAGE FORMING APPARATUS FOR RECYCLING TONER

(75) Inventors: Takeshi Watanabe, Yokohama (JP); Masashi Takahashi, Yokohama (JP); Minoru Yoshida, Machida (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 225 days.

(21) Appl. No.: 11/082,243

(22) Filed: Mar. 17, 2005

(65) Prior Publication Data

US 2006/0210322 A1 Sep. 21, 2006

(51) Int. Cl.
*G03G 15/01* (2006.01)
*G03G 15/08* (2006.01)

(52) U.S. Cl. ..... 399/299; 399/259

(58) Field of Classification Search ..... 399/252, 399/259, 302, 308, 299; 430/111.1, 111.4
See application file for complete search history.

(56) References Cited

U.S. PATENT DOCUMENTS 4,727,395 A 2/1988 Oda et al.
6,690,905 B2 * 2/2004 Takahashi et al. ..... 399/302
6,920,300 B2 7/2005 Watanabe et al.
2004/0156658 A1 8/2004 Aoki et al.
2005/0031383 A1 2/2005 Watanabe et al.
2005/0069355 A1 3/2005 Watanabe et al.

FOREIGN PATENT DOCUMENTS

JP 07-064366 A 3/1995
JP 3342217 B2 8/2002

OTHER PUBLICATIONS

U.S. Pat. Appl. No. 11/081,962, filed Mar. 17, 2005, Yoshida et al.
U.S. Pat. Appl. No. 10/385,716, filed Mar. 12, 2003, Aoki et al.

* cited by examiner

*Primary Examiner*—Hoang Ngo
(74) *Attorney, Agent, or Firm*—Foley & Lardner LLP

(57) ABSTRACT

In a tandem type color image forming apparatus having a function which collects a residual toner for recycle, a particle diameter distribution of a carrier is expressed as that a ratio of the number of carrier particles whose particle diameter is not smaller than $\phi 40$ μm is not greater than 5% and a ratio of the number of carrier particles-whose particle diameter is not smaller than $\phi 30$ μm is not greater than 20%, or an intermediate transfer body which has a laminated structure including two or more layers and has a layer with the low hardness arranged on an image carrier, or a total toner layer thickness T1+T2+T3 of first to third transfer image is less than 30 μm.

20 Claims, 5 Drawing Sheets

IMAGE FORMING APPARATUS FOR RECYCLING TONER

BACKGROUND OF THE INVENTION

The present invention relates to an image forming apparatus which develops a static charge image and a magnetic latent image in electrophotography, electrostatic printing, magnetic recording and others, and more particularly to an image forming apparatus using a heat fusing scheme such as heat roller fusing.

A cleanerless process which does not have a cleaner such as a blade on a photoreceptor surface is a technique which is advantageous to a reduction in size of an apparatus or conservation of a toner, and various inventions of the cleanerless process have been disclosed. For example, U.S. Pat. No. 4,727,395 discloses a development/simultaneous cleaning technique in an reversing phenomenon. In particular, this technique is also effective in realization of full color in recent image forming apparatuses and has begun to be adopted in a four-drum tandem mode, and, e.g., Japanese Patent No. 3342217, Jpn. Pat. Appln. KOKAI Publication No. 7-64366 and others disclose examples concerning the cleanerless process having this tandem configuration.

As merits of the cleanerless process, there are simplification of a configuration since a photoreceptor cleaner is not necessary, realization of long duration of life of a photoreceptor because the photoreceptor is not scraped by a cleaner, an improvement in toner consumption efficiency since a post-transfer residual toner is recovered by a developing device for recycling, and others. However, considering a color configuration of the tandem mode, there is a problem that reverse transfer from a color station on a preceding stage to a color station on a subsequent stage occurs and a mixed color is generated depending on an image to be printed, thereby resulting in a change in hue.

This reverse transfer is generated when a yellow toner is transferred onto a transfer medium such as a paper sheet or an intermediate transfer body in, e.g., a first transfer station and then the transfer medium passes through a transfer station for, e.g., a cyan color on a subsequent stage. At this time, if a condition that a cyan toner is also transferred is provided, the cyan toner is transferred onto the yellow toner on the transfer medium. However, if a condition that the cyan toner is not transferred onto a part where the yellow toner has been already transferred on the transfer medium is combined, a part of the yellow toner on the transfer medium disadvantageously adheres to a photoreceptor of a cyan station. Further, the reverse-transferred yellow toner is collected in a developing device of the cyan station since the photoreceptor of the cyan station is not provided with a cleaner. When this process is repeated, a hue of a developing agent in the cyan developing device gradually changes, and a so-called mixed color is generated.

That is, in order to avoid generation of a mixed color, it is important to prevent reverse transfer from occurring, and it is known that this reverse transfer can be improved by enhancing mold release properties of a photoreceptor or reducing the adherence between a photoreceptor and a toner by, e.g., adopting a spherical toner which can decrease a contact surface. Furthermore, reverse transfer is greatly affected by an electric discharge phenomenon, and a reverse transfer generation quantity is increased when the transfer bias is high whilst this generation quantity is decreased when the transfer bias is lowered. In a regular process, when the transfer bias is lowered to a level at which reverse transfer hardly occurs, a transfer electric field is insufficient and the post-transfer residual toner is increased. However, by combining the photoreceptor with the excellent mold release properties, the spherical toner and others, it is possible to obtain transfer efficiency which has no problem from a practical standpoint even if the bias is lowered to a level at which reverse transfer hardly occurs.

Moreover, since the reverse transfer phenomenon is greatly affected by electric discharge, there has been proposed a method which reduces the reverse transfer phenomenon by contriving a configuration of a transfer section. Since the electric discharge which generates reverse transfer is produced in a small air gap between a part where a non-image section of a photoreceptor moves close to a transfer medium which supports a toner of a station on a preceding stage and a part where the non-image section moves apart from the toner, the above-described method lowers an electric field in a state where the both members come close to each other or move away from each other to a level at which no electric discharge is generated on both the inlet side and the outlet side of a contact nip of the both members. By doing so, the reverse transfer can be considerably reduced. However, even in this state, if the both members are in contact with each other in the transfer nip, the electric discharge is generated and the reverse transfer occurs when the adhesion of the both members is not stabilized. Additionally, when the transfer nip is broadened in such a configuration, an advantage can be obtained if the adhesion is stably achieved, but the reverse transfer or an image disturbance is apt to be excessively produced if the adhesion becomes unstable due to a small blur or foreign particles.

Here, as factors which make the adhesion unstable, the following can be considered. For example, when two-component development is used, a developing agent comprises a toner and a carrier. A particle diameter of the toner is approximately 3 to 12 μm and, on the other hand, a particle diameter of the carrier is approximately 20 to 80 μm.

In a usual state, the carrier electrizes and carries the toner in the developing device, forms an ear by a magnetic force in a state where the toner is supported on a developing roller, and then returns to the inside of the developing device for circulation. The carrier stays in the developing device and does not adhere to the photoreceptor in the normal state. However, the carrier has an operating life, and its coercive force may be weakened and the carrier may partially adhere to the photoreceptor when the carrier is deteriorated in some cases, for example. In this example, since the particle diameter of the carrier is larger than that of the toner, the carrier is intervened between the transfer medium and the photoreceptor in the transfer nip, and the adhesion between the photoreceptor and the transfer medium thereby becomes unstable so that an air gap is produced, thereby generating abnormal electric discharge. That is, with generation of the abnormal electric discharge, a reverse transfer quantity is increased. Additionally, in case of the cleanerless process, since the carrier cannot be readily collected by a regular cleaner or the like when the carrier adheres to the photoreceptor, an influence of the carrier is serious as compared with a process using a cleaner. That is, the carrier may repeatedly stay on the photoreceptor and keep adversely affecting in the transfer section in some cases, and a mixed color due to the reverse transfer as well as an image defect such as transfer irregularities can be saliently generated.

Further, the adhesion is also affected by a step between a part where the toner is developed and a part where the toner is not developed.

For example, in cases where printing is performed in each solid color and a thickness is set to 15 μm, an air gap of 15 μm is generated between an image section and a non-image section of a magenta image in a magenta station at a subsequent stage with a yellow toner being developed on a transfer medium. Furthermore, if the same pattern as that in the magenta station is obtained in a cyan station on a subsequent stage, a step between the transfer medium which supports an yellow image in the cyan station and the non-image section in the cyan station is 30 μm at maximum. As described above, a step generated due to presence/absence of the toner leads to the unstableness of the adhesion between a belt and the photoreceptor and generation of an air gap, and abnormal electric discharge is thereby produced, resulting in an increase in reverse transfer quantity.

BRIEF SUMMARY OF THE INVENTION

In view of the above-described problems, it is an object of the present invention to suppress occurrence of reverse transfer and avoid generation of a mixed color over a long period in a cleanerless process having a tandem configuration by providing a structure or conditions which prevent abnormal electric discharge from being generated due to a step of a carrier or a toner.

At first, according to the present invention, there is provided an image forming apparatus configured to form a color image, which comprises a plurality of image forming stations each comprising an image carrier, a developing device which is provided on the image carrier, accommodates a developing agent containing a toner and a carrier and forms a toner image on the image carrier, and a mechanism which collects the toner remaining on the image carrier after toner image transfer by the developing device; and a toner image transfer section which transfers the toner image onto a transfer medium, wherein a ratio of the number of carrier particles having a particle diameter which is not less than 40 μm is not greater than 5% of a total number of the carrier particles, and a ratio of the number of carrier particles having a particle diameter which is not less than 30 μm is not greater than 20% of the total number of the carrier particles.

At second, according to the present invention, there is provided an image forming apparatus comprising:

a plurality of image forming stations each comprising an image carrier, a developing device which is provided on the image carrier, retains a developing agent containing a toner and a carrier and forms a toner image on the image carrier, and a mechanism which collects the toner remaining on the image carrier after toner image transfer by the developing device;

a toner image transfer section which transfers the toner image onto an intermediate transfer body; and a color image transfer section provided on a rear stage of the plurality of image stations, wherein the intermediate transfer body has a laminated structure including at least two layers, and the hardness of an outermost layer which is in contact with the image carrier is lower than that of at least one of the other layers.

At third, according to the present invention, there is provided an image forming apparatus comprising:

first to third image forming stations each comprising an image carrier, a developing device which is provided on the image carrier, retains a developing agent containing a toner and a carrier and forms a toner image on the image carrier, and a mechanism which collects the toner remaining on the image carrier after toner image transfer by the developing device; and a toner image transfer section which transfers the toner image onto a transfer medium, wherein the image forming apparatus has a relationship expressed as $T1+T2+T3<30$ μm, where T1 μm is a thickness of the toner which is formed in the first image forming station and transferred onto the transfer medium, T2 μm is a thickness of the toner which is formed in the second image forming station and transferred onto the transfer medium, and T3 μm is a thickness of the toner which is formed in the third image forming station and transferred onto the transfer medium.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
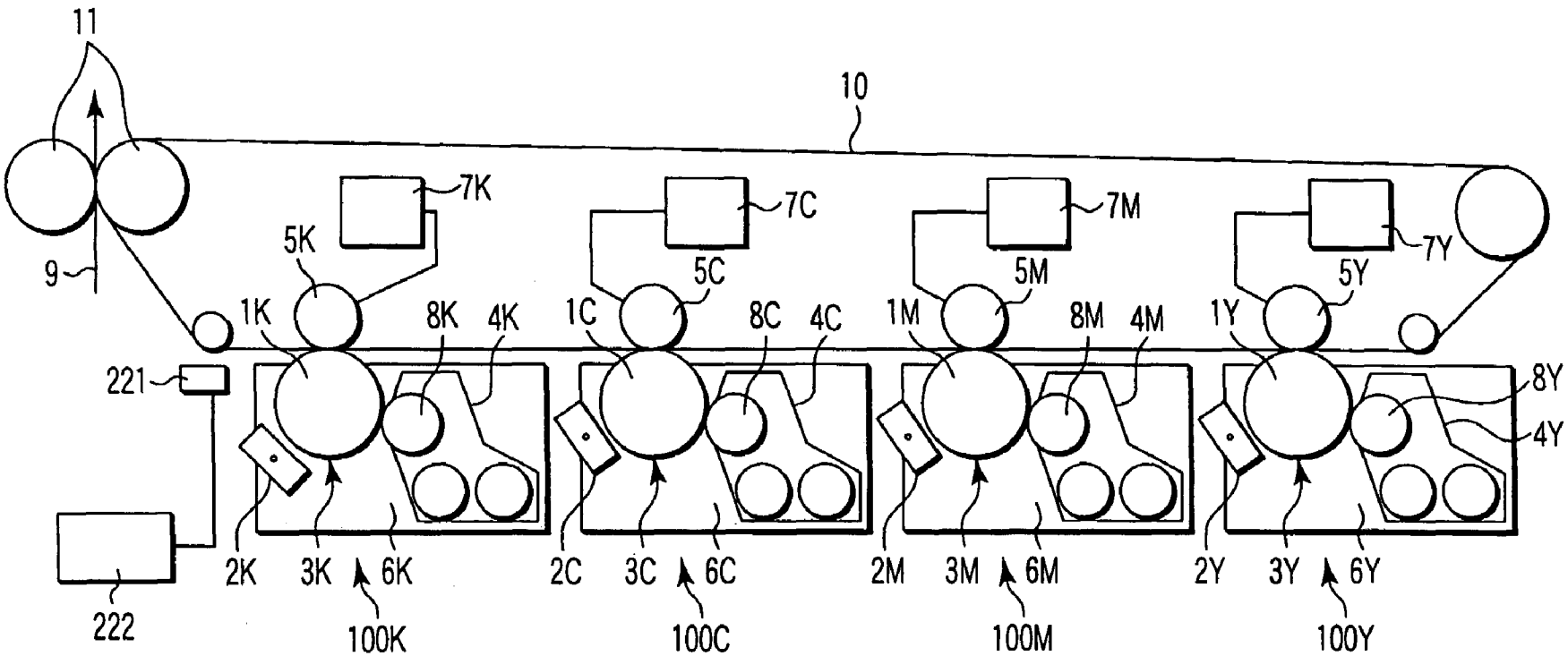
FIG. 1 is a schematic view showing an example of an image forming apparatus according to the present invention.

An image forming apparatus according to the present invention is roughly classified into first to third aspects.

The invention according to the first to third aspects relates to an image forming apparatus comprising: a plurality of image forming stations each including an image carrier, a developing device which is provided on the image carrier, retains a developing agent containing a toner and a carrier and forms a toner image on the image carrier, and a mechanism which collects the toner remaining on the image carrier after transferring the toner image by the developing device; and a toner image transfer section which transfers the toner image onto a transfer medium, the image forming apparatus being able to form a color image.

The image forming apparatus according to the first aspect has, in addition to the above-described configuration, characteristics in which a ratio of the number of carrier particles having a particle diameter which is not smaller than 40 μm is not greater than 5% of the total number of the carrier particles and a ratio of the number of carrier particles having a particle diameter which is not smaller than 30 μm is not greater than 20% of the total number of the carrier particles in the above-described carrier.

Further, the image forming apparatus according to the second aspect has, in addition to the above-described configuration, characteristics in which the transfer medium is an intermediate transfer body, the intermediate transfer body having a laminated structure including at least two layers, the hardness of the outermost layer which is in contact with the image carrier being lower than that of at least one of the other layers, a color image transfer section which finally transfers a color image formed on the intermediate transfer body onto a recording member being further provided.

Furthermore, the image forming apparatus according to the third aspect has, in addition to the above-described configuration, characteristics in which the plurality of image forming stations include first to third image forming stations and have a relationship represented by $T1+T2+T3<30$ μm, where T1 μm is a thickness of a toner which is formed in the first image forming station and transferred onto the transfer medium, T2 μm is a thickness of the toner which is formed in the second image forming station and transferred onto the transfer medium and T3 μm is a thickness of the toner which is formed in the third image forming station and transferred onto the transfer medium.

According to the present invention, by using at least one of the image forming apparatuses according to the first to third aspects, it is possible to obtain an advantage that abnormal electric discharge is not generated due to a step of the carrier or the toner, irregularities in transfer can be avoided and occurrence of reverse transfer can be suppressed while generation of a mixed color can be prevented over a long period in a cleanerless process having a tandem configuration.

The plurality of image forming stations can include two or more image forming stations. Developing agents having different colors can be retained in developing devices of the respective image forming stations. For example, in case of using developing agents of four colors, i.e., yellow, magenta, cyan and black in formation of a color image, the first to fourth image forming stations can be sequentially arranged.

Moreover, in the image forming apparatus according to the second aspect, assuming that a thickness of the outermost layer is T5 μm, it is preferable that a ratio of the number of carriers having a particle diameter which is not smaller than 40+T5/2 μm to all the carrier particles to all the carrier particles is not greater than 5% and a ratio of the number of carrier particles having a particle diameter which is not smaller than 30+T5/2 μm to all the carrier particles is not greater than 10%. If each ratio falls within this range, occurrence of abnormal electric discharge due to a step of the carriers or the toner can be effectively avoided.

In the image forming apparatus according to the third aspect, it is preferable that a fourth image forming station provided with a black toner is further included and a total toner layer thickness of solid images in the first image forming station and the second image forming station is not greater than 20 μm. If the thickness falls within this range, occurrence of abnormal electric discharge due to a step of the carrier or the toner can be effectively avoided.

Additionally, the respective characteristics of the image forming apparatuses according to the first to third aspects can be combined as required. As a result, the above-described advantages become better.

The present invention will now be described hereinafter in detail with reference to the accompanying drawings.

FIG. 1 is a schematic view showing an example of an image forming apparatus according to the present invention.

As shown in the drawing, this image forming apparatus is a so-called tandem type color image forming apparatus using a cleanerless process.

In this apparatus, a plurality of image forming stations 100Y, 100M, 100C and 100K are sequentially arranged on, e.g., an intermediate transfer belt 10. A yellow developing agent, a magenta developing agent, a cyan developing agent and a black developing agent are respectively retained in these image forming stations 100Y, 100M, 100C and 100K. In this example, the same reference numerals denote the same members in the respective stations. Further, Y, M, C and K means that their members are used for forming yellow, magenta, cyan and black images, respectively.

First, in the first image forming station 100Y, an image carrier 1Y is an organic photoreceptor which has, e.g., a drum-shaped electroconductive substrate and an organic or amorphous-silicon-based photosensitive layer provided on the electroconductive substrate and is electrically charged to have a negative polarity.

This image carrier 1Y is evenly charged to, e.g., −500V in a charging section by a known charger 2Y, e.g., a roller charger, a corona charger, a scorotron charger or the like.

Thereafter, in an exposure section, the image carrier 1Y is subjected to an exposure 3Y by, e.g., a image-modulated laser beam or LED, and an electrostatic latent image is thereby formed on the surface. At this time, a potential on the surface of the exposed photoreceptor becomes, e.g., approximately −80V.

Then, in a development section, the electrostatic latent image is converted into a visible image by a developing device 4Y. The developing device 4Y forms an ear using the carrier on a developing roller provided with a magnet in a two-component developing mode in which a non-magnetic toner charged to have a negative polarity is mixed with a magnetic carrier, and applies a bias voltage of approximately −200V to −400V to the developing roller. As a result, the toner adheres to the exposed image carrier surface so that a toner image is formed, but the toner does not adhere to the non-exposed surface.

Furthermore, in a transfer section, the toner image on the image carrier 1Y is transferred onto a transfer medium such as the intermediate transfer belt 10, thereby obtaining a first transfer image. Supply of an electric field at this time is performed by a transfer member 5Y such as a transfer roller, a transfer blade or a transfer brush which is brought into contact with the rear surface of the intermediate transfer belt 10. A voltage applied to the transfer member 5Y from a power supply 7Y is approximately +300V to 2 kV.

After the transfer, in regard to the residual toner or the like remaining on the image carrier 1Y, a memory of a post-transfer residual image is removed by a non-illustrated disturbing member as required. Moreover, the image carrier 1Y is appropriately subjected to discharge processing, and then the charge process is again repeated. At this time, the post-transfer residual toner which has passed through the charger 2Y is charged to have the same polarity as the charge potential of the image carrier 1Y, e.g., a negative polarity. When the post-transfer residual toner reaches the developing device 4Y, a new toner is developed while overlapping the post-transfer residual toner on the image carrier 1Y in an image section and, on the other hand, a mechanism which collects the post-transfer residual toner toward a developing roller 8Y side by an electric field, i.e., a so-called development/simultaneous cleaning mechanism is provided in a non-image section. As a result, even if a cleaning device such as a blade is not provided on the image carrier 1Y, an electrophotographic process of a first image forming station 6Y is continuously performed. Additionally, the collected toner can be recycled together with the unused toner in the developing device 4Y.

Subsequently, in the second image forming station 100M, like the first image forming station 100Y, an electrostatic latent image is formed by charging and an exposure, and a toner image is formed by performing development. Then, transfer is likewise carried out on the intermediate transfer belt 10 having a first transfer image formed thereon, thereby forming a second transfer image. After the transfer, the residual toner remaining on the image carrier 1M is also developed or collected by the development/simultaneous cleaning mechanism.

Likewise, in the third image forming station 100C and the fourth image forming station 100K, after formation of an electrostatic latent image by the same charging and exposure and formation of a toner image by performing development, a third transfer image is formed on the intermediate transfer belt 10 having a first transfer image and a second transfer image formed thereon, and then a fourth transfer image is formed on the intermediate transfer belt 10 having the first transfer image, the second transfer image and the third transfer image formed thereon, thereby obtaining a color image. After the transfer, the residual toner remaining on each image carrier is developed or collected by the development/simultaneous cleaning mechanism.

It is to be noted that this image forming apparatus further has a color image transfer section 11 which transfers a color image finally obtained on the intermediate transfer belt 10 by using the toner having the plurality of colors onto a recording member 9 such as a paper sheet. As a result, a color image transferred onto a paper sheet or the like is then passed through a non-illustrated fuser, thereby acquiring an output image.

The present invention prevents a phenomenon that a transfer image which has been already transferred onto the intermediate transfer belt 10, e.g., the first transfer image is reverse-transferred onto an image carrier on a subsequent stage, e.g., the second image carrier from occurring in the above-described color image forming process.

A mechanism of occurrence of the reverse transfer phenomenon will now be described taking the second image forming station 100M as an example.

For example, the first transfer image which has been already transferred onto the intermediate transfer belt 10 has a negative polarity, and a voltage of approximately +300V to 3 kV is applied to the transfer member 5M even when the second transfer image is transferred, and hence the first transfer image basically does not move from the surface of the intermediate transfer belt 10. However, when an electric discharge phenomenon occurs in the transfer of the second transfer image, the toner of the first transfer image is partially inversely charged to have a positive polarity and adheres to the second image carrier 1M side. The toner of the first transfer image which has adhered to the second image carrier 1M in this manner is caused to again have the negative polarity by the second charger 2M, comes to be mixed in the second developing device and provokes a mixed color phenomenon depending on conditions.

Although the above has described the second image forming station 100M, such a phenomenon can also occur in the third image forming station 100C and the fourth image forming station 100K.

It is to be noted that the development/simultaneous cleaning mechanism is used as a mechanism which collects the toner remaining on the image carrier after transfer of a toner image by the developing device in the above-described apparatus, but it is possible to use a toner recycle mechanism or the like which once collects the residual toner by a cleaning blade or the like and then returns the toner to each developing device by using a dedicated carriage path.

The present invention will now be more concretely described hereinafter with reference to an experimental example.

Example of Image Formation using Intermediate Transfer Belt having Single Layer

An image forming apparatus having the same configuration as that depicted in FIG. 1 was used, and occurrence of color irregularities and the like were checked while changing a distribution of the number of carrier particles in a developing agent used, a configuration of the intermediate transfer belt, a thickness of a toner image, a nip width in the transfer section and others in many ways.

In the image forming apparatus for this experiment, a diameter of each photoreceptor was determined as ϕ30 mm, an intermediate transfer belt which is formed of polyimide and has the micro-hardness of 95° was used, a diameter of a transfer member was determined as ϕ16 mm, and a semiconductive roller having the JIS-A hardness of approximately 30° was employed. It is to be noted that the micro-hardness was measured by MICRO DUROMETER METER MJ1 manufactured by Koubunshi Keiki Co., Ltd.

As a carrier, magnetic powder formed of ferrite coated with silicon resin was used.

First, the above-described carrier having an average particle diameter of approximately 28 μm was prepared, and its number/particle diameter distribution was measured.

Figure 2:
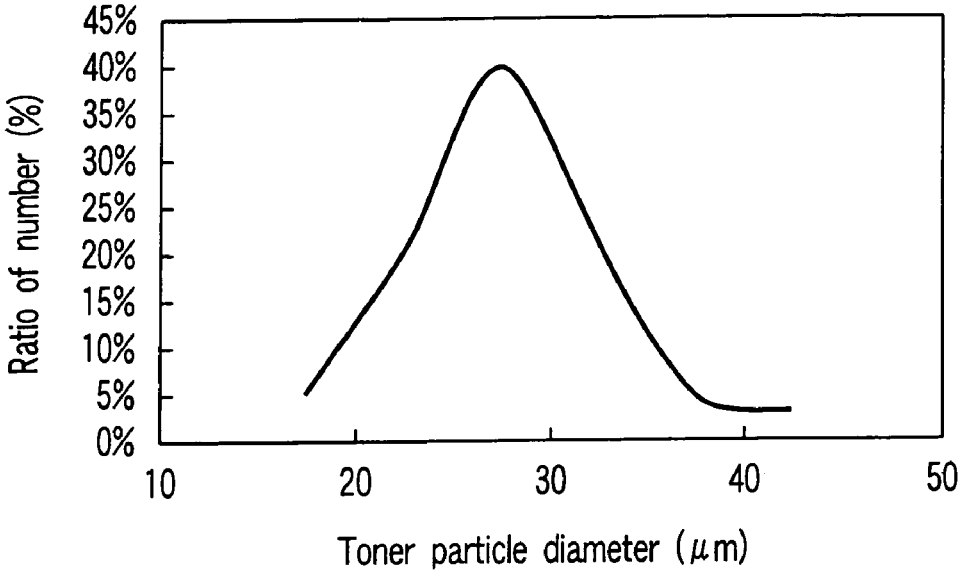
FIG. 2 is a graph showing a measurement result of a number/particle size distribution of a carrier.

FIG. 2 is a graph showing a measurement result of the number/particle diameter distribution of the carrier.

Consequently, as shown in the drawing, a ratio of the number of the carrier particles having a particle diameter of 25 to 30 μm to the entire carrier particles is approximately 40%; a ratio of the number of the carrier particles having a particle diameter of 20 to 25 μm is 20%; a ratio of the number of the carrier particles having a particle diameter of 30 to 35 μm is 20%; a ratio of the number of the carrier particles having a particle diameter of 35 to 40 μm is 6%, a ratio of the number of the carrier particles having a particle diameter which is not smaller than 40 μm is approximately 6%; and a ratio of the number of the carrier particles having a particle diameter which is less than 20 μm is approximately 8%. The distribution was substantially symmetrical with an average particle diameter 28 μm at the center. This is determined as Sample 1.

An image formation experiment was conducted by using a two-component developing agent in which the carrier having such a number/particle diameter distribution is mixed with the toner.

It is to be noted that compositions of a yellow developing agent, a magenta developing agent, a cyan developing agent and a black developing agent as follows.

| Yellow Developing agent | |
|---|---|
| Yellow toner composition | |
| Coloring agent: a yellow G | 5 parts by weight |
| Binder: polyester resin | 84 parts by weight |
| Charge control agent: | 1 part by weight |

-continued

| | |
|---|---|
| Waxing compound: rice wax | 10 parts by weight |
| Mixing quantity of the carrier to 100 parts by weight of the yellow toner: | 7.5 parts by weight |
| Magenta Developing agent | |
| Magenta toner composition | |
| Coloring agent: irgazin red | 5 parts by weight |
| Binder: polyester resin | 84 parts by weight |
| Charge control agent | 1 part by weight |
| Waxing compound: rice wax | 10 parts by weight |
| Mixing quantity of the carrier to 100 parts by weight of the magenta toner | 7.5 parts by weight |
| Cyan Developer | |
| Cyan toner composition | |
| Coloring agent: copper phthalocyanine pigment | 5 parts by weight |
| Binder: polyester resin | 84 parts by weight |
| Charge control agent | 1 part by weight |
| Waxing compound: rice wax | 10 parts by weight |
| Mixing quantity of the carrier to 100 parts by weight of the cyan toner | 7.5 parts by weight |
| Black Developer | |
| Black toner composition | |
| Coloring agent: carbon black | 5 parts by weight |
| Binder: polyester resin | 84 parts by weight |
| Charge control agent | 1 part by weight |
| Waxing compound: rice wax | 10 parts by weight |
| Mixing quantity of the carrier to 100 parts by weight of the black toner | 7.5 parts by weight |

An image formation experiment result had no problem on the initial stage and less reverse transfer. The carrier hardly adhered to the photoreceptor in the initial state.

However, when image formation is repeated over a long period, physical properties are gradually deteriorated, and the carrier adheres to the photoreceptor side in some cases. Thus, after performing formation of a test pattern image on approximately 10,000 paper sheets at a printing ratio of approximately 10% in a paper sheet of A4 size, post-transfer toner residue and a reverse transfer generation state were checked.

Post-Transfer Toner Residue and Reverse Transfer Test

Image irregularities in an obtained test were obtained in a halftone image, and the post-transfer residual toner remaining on the photoreceptor was obtained by using a mending tape and installed on a white paper sheet. The post-transfer toner residue and the reverse transfer occurrence were checked by measuring the image irregularities and the post-transfer residual toner and visually evaluating them. In regard to a result, a case in which the partial concentration unevenness is hardly seen was evaluated as ○ and a case in which the partial concentration unevenness is seen was evaluated as ×, respectively. Further, as to reverse transfer, the surface of the photoreceptor on the rear stage rather than the post-transfer residual toner was taped and evaluated.

As a result, the reverse transfer was locally generated at a part corresponding to a carrier position in particular, and irregularities were produced in an image corresponding to a subtle halftone.

Then, in regard to a carrier constituting the above-described carrier, carrier particles having a particle diameter larger than an average particle diameter were removed by using, e.g., a classifier so that such a number/particle diameter distribution as shown in Table 1 can be obtained, and then the same test was conducted.

Table 1 shows its results.

TABLE 1

| | Particle diameter range | | | | | | |
|---|---|---|---|---|---|---|---|
| | To 25 (μm) | 25–30 (μm) | 30–35 (μm) | 35–40 (μm) | Not smaller than 40 (μm) | Average number of particles of 30 μm or above | Image irregularities |
| Sample 1 | 28% | 40% | 20% | 6% | 6% | 32% | X |
| Sample 2 | 30% | 42% | 21% | 6% | 1% | 28% | X |
| Sample 3 | 32% | 45% | 21% | 1% | 1% | 23% | X |
| Sample 4 | 35% | 46% | 17% | 1% | 1% | 19% | ○ |
| Sample 5 | 40% | 51% | 1% | 1% | 7% | 9% | X |
| Sample 6 | 41% | 52% | 1% | 1% | 5% | 7% | ○ |
| Sample 7 | 39% | 49% | 1% | 6% | 5% | 12% | ○ |
| Sample 8 | 35% | 46% | 8% | 6% | 5% | 19% | ○ |
| Sample 9 | 34% | 45% | 10% | 6% | 5% | 21% | X |
| Sample 10 | 35% | 46% | 6% | 6% | 7% | 19% | X |

First, the ratio of the number of carrier particles with a particle diameter of 40 μm or above which was 6% in Sample 1 was reduced to less than 1% in order to create Sample 2, and the same test was conducted. As result, a large difference from Sample 1 before classification was not observed, the reverse transfer was locally generated after forming an image on 10,000 paper sheets as expected, and irregularities corresponding to the reverse transfer were generated in the image.

Subsequently, the ratio of the number of the carrier particles having a particles size of 35 to 40 μm as well as the carrier particles having a particle diameter of 40 μm or above was reduced from 6% to less than 1%, thereby creating Sample 3. The same test as Sample 1 was conducted with respect to the obtained Sample 3. As a result, a large difference in result from Sample 1 and Sample 2 was not observed.

Furthermore, the ratio of the number of the carrier particles having a particle diameter of 30 to 35 μm was reduced from 21% to 17%, and the ratio of the number of the carrier particles having a particle diameter of 35 μm or above was reduced to 1%, thereby creating Sample 4. The same test as Sample 1 was conducted with respect to the obtained sample. As a result, occurrence of the reverse transfer was hardly seen, and an image without irregularities was obtained.

Moreover, the reverse transfer was deteriorated in Sample 5 in which the ratio of the number of the carrier particles having a particle diameter of 30 to 35 μm and the ratio of the number of the carrier particles having a particle diameter of 35 to 40 μm were respectively reduced to less than 1%. In this example, the ratio of the number of the carrier particles having a particle diameter of 30 to 35 μm and the ratio of the number of the carrier particles having a particle diameter of 35 to 40 μm were respectively reduced to less than 1%, and the ratio of the number of the carrier particles having a particle diameter of 40 μm or above was set to 5%, thereby creating Sample 6. The same test as Sample 1 was conducted with respect to the obtained sample. As a result, the reverse transfer was hardly observed, and an excellent image having substantially no irregularity was obtained.

Subsequently, as shown in the above table, the number of the carrier particles whose particle diameter is larger than an average particle diameter of the entire carrier particles is slightly increased, thereby creating Samples 7, 8, 9 and 10. The same test was conducted with respect to the obtained samples. As a result, it was revealed that the reverse transfer is not generated and an excellent image with no irregularity can be obtained if the ratio of the number of the carrier particles having a particle diameter of 30 μm or above is not greater than approximately 20% and the ratio of the number of the carrier particles having a particle diameter of 40 μm or above is not greater than 5%.

Since the local reverse transfer and the corresponding image irregularities make the adhesion between the photoreceptor and the transfer medium unstable, a diameter of each carrier particle is reduced and ratios of the carrier particles having large particle diameters are decreased in order to avoid this phenomenon in the above-described samples. However, there is also the following method.

For example, by arranging an elastic body on the surface of the intermediate transfer body which servers as a transfer medium, the adhesion of a peripheral section can be prevented from being affected even if foreign particles such as a carrier exist in the transfer nip. If the hardness of the intermediate transfer body is high, an air gap is generated in the transfer nip when the carrier is intervened between the photoreceptor and the intermediate transfer body, and the adhesion becomes unstable, which generates the local reverse transfer, resulting in a tendency of production of image irregularities.

At this time, when an elastic belt such as a rubber belt is used as the intermediate transfer body, a color shift is apt to occur.

Thus, according to the image forming apparatus according to the second aspect, the intermediate transfer belt has a laminated structure including two or more layers, and a layer having the lower hardness is arranged on the surface which is in contact with the photoreceptor, thereby stabilizing the adhesion. On the other hand, as the layer provided at a part other than the surface, a layer having the hardness higher than that of the surface which is in contact with the photoreceptor is used, thus alleviating the stretch of the intermediate transfer belt which adversely affects the color shift.

Here, in regard to conditions of the surface layer of the intermediate transfer body, it is preferable that a thickness of the surface layer having the lower hardness is a determined value or above in order to reduce occurrence of an air gap due to the carrier.

Example of Image Formation Using Intermediate Transfer Belt having Two-layer Structure Samples 1 to 10 were respectively applied in order to form an image and the same test was conducted in the same way except that the intermediate transfer belt having a two-layer structure was used as a transfer medium, the intermediate transfer belt having a structure in which an electroconductive rubber layer which is formed of a material of fluorine rubber and has the JIS-A hardness of approximately 50° and a thickness of 10 μm is superimposed on the surface which is in contact with the photoreceptor and a layer which is formed of polyimide having the higher hardness of the former layer and has the micro-hardness of 95° is superimposed on the opposite layer.

As a result, image irregularities due to the reverse transfer were not generated in any sample.

Further, a particles size of carrier particles was entirely increased by approximately 5 μm in each of Samples 1 to 10, thereby creating Samples 11 to 20. The same test was conducted with respect to the obtained samples. Table 2 shows its results.

TABLE 2

| | Particle diameter range | | | | | | | | |
|---|---|---|---|---|---|---|---|---|---|
| | To 30 (μm) | 30–35 (μm) | 35–40 (μm) | 40(μm) or above | 45(μm) or above | Average number of particles of 30 μm or above | Average number of particles of 35 μm or above | Average number of particles of 40 μm or above | Image irregularities |
| Sample 11 | 33% | 35% | 20% | 6% | 6% | 67% | 32% | 12% | X |
| Sample 12 | 35% | 37% | 21% | 6% | 1% | 65% | 28% | 7% | X |
| Sample 13 | 37% | 40% | 21% | 1% | 1% | 63% | 23% | 2% | X |
| Sample 14 | 40% | 41% | 17% | 1% | 1% | 60% | 19% | 2% | ○ |
| Sample 15 | 45% | 46% | 1% | 1% | 7% | 55% | 9% | 8% | X |
| Sample 16 | 46% | 47% | 1% | 1% | 5% | 54% | 7% | 6% | ○ |
| Sample 17 | 44% | 44% | 1% | 6% | 5% | 56% | 12% | 11% | ○ |
| Sample 18 | 40% | 41% | 8% | 6% | 5% | 60% | 19% | 11% | ○ |

TABLE 2-continued

| | Particle diameter range | | | | | | | | |
|---|---|---|---|---|---|---|---|---|---|
| | To 30 (μm) | 30–35 (μm) | 35–40 (μm) | 40(μm) or above | 45(μm) or above | Average number of particles of 30 μm or above | Average number of particles of 35 μm or above | Average number of particles of 40 μm or above | Image irregularities |
| Sample 19 | 39% | 40% | 10% | 6% | 5% | 61% | 21% | 11% | X |
| Sample 20 | 40% | 41% | 6% | 6% | 7% | 60% | 19% | 13% | X |

As shown in Table 2, the reverse transfer was hardly observed, and an excellent image having substantially no irregularity was obtained.

When image formation was performed by using the intermediate transfer belt in which the rubber layer having a thickness of 10 μm is provided on the photoreceptor side in this manner, the reverse transfer was not generated and the excellent result was obtained under the conditions that a ratio of the number of the carrier particles having a particle diameter of 35 μm or above is not greater than 20% and a ratio of the number of the carrier particles having a particle diameter of 45 μm or above is not greater than 5%.

Furthermore, the carrier particle diameter was increased by approximately 10 μm in Samples 1 to 10, thereby creating Samples 21 to 30. Image formation was carried out with respect to these samples by using an image forming apparatus in which a thickness of the rubber layer is changed to 20 μm, and the same test was conducted. Table 3 shows its results.

TABLE 3

| | Particle Diameter range | | | | | | | | |
|---|---|---|---|---|---|---|---|---|---|
| | To 30 (μm) | 30–35 (μm) | 35–40 (μm) | 40 (μm) or above | 45 (μm) or above | Average number of particles of 30 μm or above | Average number of particles of 35 μm or above | Average number of particles of 40 μm or above | Image irregularities |
| Sample 21 | 13% | 55% | 20% | 6% | 6% | 87% | 32% | 12% | X |
| Sample 22 | 15% | 57% | 21% | 6% | 1% | 85% | 28% | 7% | X |
| Sample 23 | 17% | 60% | 21% | 1% | 1% | 83% | 23% | 2% | X |
| Sample 24 | 20% | 61% | 17% | 1% | 1% | 80% | 19% | 2% | ○ |
| Sample 25 | 25% | 66% | 1% | 1% | 7% | 75% | 9% | 8% | X |
| Sample 26 | 26% | 67% | 1% | 1% | 5% | 74% | 7% | 6% | ○ |
| Sample 27 | 24% | 64% | 1% | 6% | 5% | 76% | 12% | 11% | ○ |
| Sample 28 | 20% | 61% | 8% | 6% | 5% | 80% | 19% | 11% | ○ |
| Sample 29 | 19% | 60% | 10% | 6% | 5% | 81% | 21% | 11% | X |
| Sample 30 | 20% | 61% | 6% | 6% | 7% | 80% | 19% | 13% | X |

As shown in Table 3, the excellent results were obtained under the conditions that a ratio of the number of the carrier particles having a particle diameter of 40 μm or above is not greater than 20% and a ratio of the number of the carrier particles having a particle diameter of 50 μm or above is not greater than 5%. Based on this, it was understood that a threshold value of the carrier particle diameter with which the local reverse transfer is not generated is large in the case where the rubber layer is provided on the surface as compared with the case where the elastic layer is lacking by an amount corresponding to approximately ½ of the thickness of the elastic layer.

Based on this result, it was revealed that, when the elastic layer is provided on the surface, it is preferable that a ratio of the average number of the carrier particles having a particle diameter which is not smaller than 30 (μm)+the thickness (μm) of the elastic layer×½ is not greater than 10% and a ratio of the average number of the carrier particles having a particle diameter which is not smaller than 40 (μm)+the thickness (μm) of the elastic layer×½ is not greater than 5%.

Although the surface layer of the intermediate transfer body is the elastic body, the surface layer does not collapse over the entire area corresponding to the thickness. Moreover, when the carrier is intervened, a degree of collapse and deformation of course subtly varies depending on the hardness of the surface layer, a transfer pressure and a carrier particle diameter. However, the carrier particle diameter is small and a large quantity of carrier particles do not exist at the same time. Therefore, a load is intensively applied, and it can be considered that the substantially stable advantage can be obtained with a transfer pressure which falls within in a practical range.

Example of Image Forming Apparatus having Modified Transfer Member

In the cleanerless process, although the high transfer efficiency is required, the electric discharge is apt to occur when a transfer electric field is intensified, and hence a configuration in which the electric discharge is hardly generated and the transfer electric field can be assuredly applied is suitable for the transfer section.

As an example of such a configuration, there is a configuration in which a contact nip width between the intermediate transfer belt and the photoreceptor is increased to be larger than a nip width between the photoreceptor and the transfer member having a voltage applied thereto.

Figure 3:
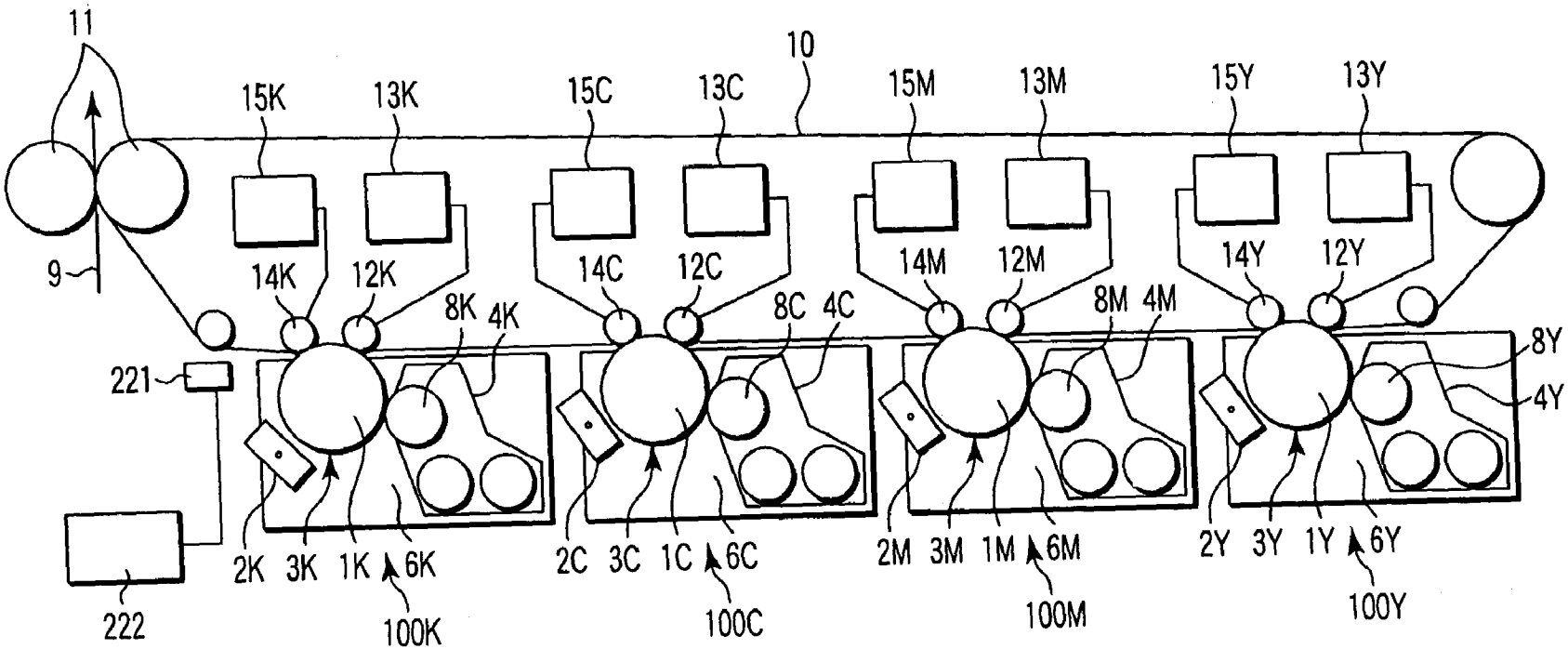
FIG. 3 is a schematic view showing a modification of the image forming apparatus according to the present invention.
Figure 4:
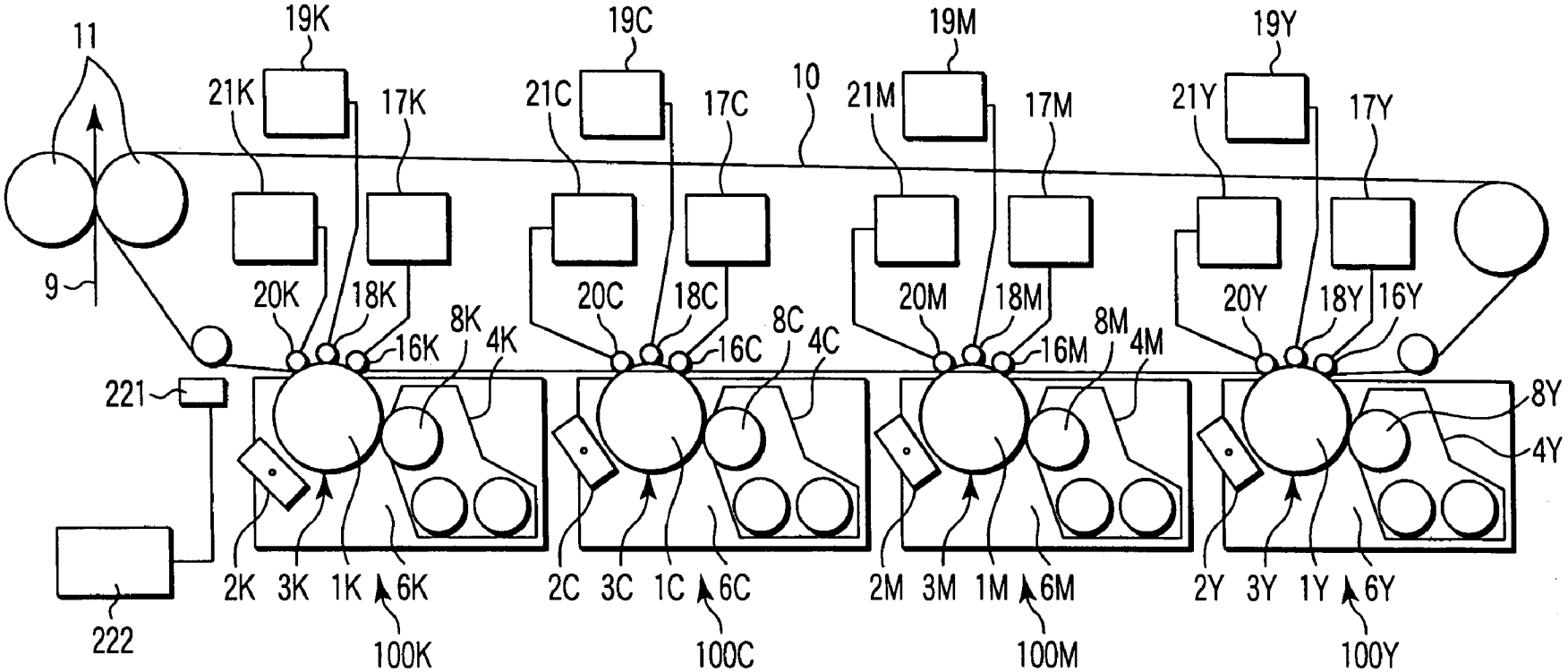
FIG. 4 is a schematic view showing a modification of the image forming apparatus according to the present invention.
Figure 5:
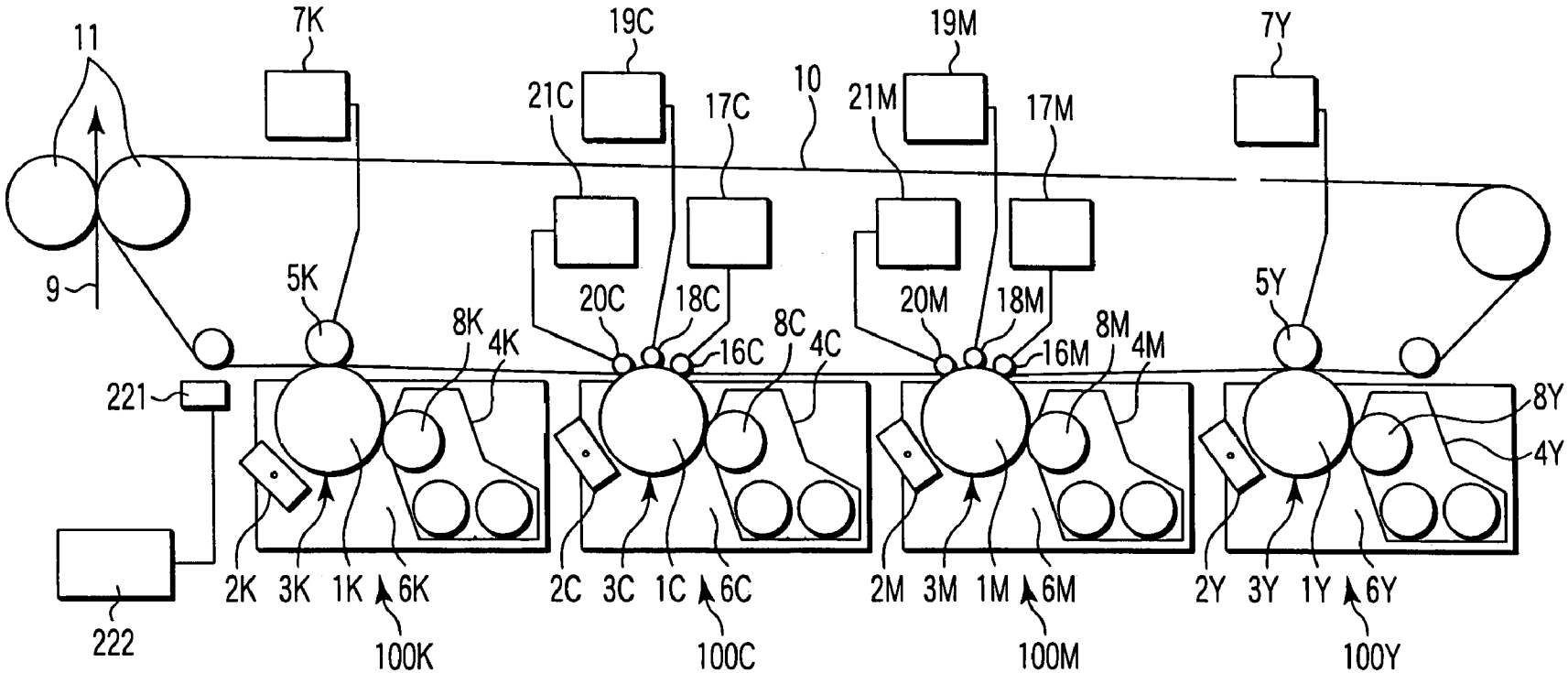
FIG. 5 is a schematic view showing a modification of the image forming apparatus according to the present invention.

FIGS. 3 to 5 are schematic views each showing an example of an image forming apparatus in which a transfer member of the image forming apparatus is modified.

FIG. 3 shows an image forming apparatus having the same configuration as that of FIG. 1 except that two transfer rollers 12Y and 14Y having respective power supplies 13Y and 15Y connected thereto in the vicinity of the transfer nip are provided in place of the transfer member 5Y having the power supply 7Y connected thereto, two transfer rollers 12M and 14M having respective power supplies 13M and 15M connected thereto in the vicinity of the transfer nip are provided in place of the transfer member 5M having the power supply 7M connected thereto, two transfer rollers 12C and 14C having respective power supplies 13C and 15C connected thereto in the vicinity of the transfer nip are provided in place of the transfer member 5C having the power supply 7C connected thereto and two transfer rollers 12K and 14K having respective power supplies 13C and 15K connected thereto in the vicinity of the transfer nip are provided in place of the transfer member 5K having the power supply 7K connected thereto.

In this apparatus, a contact nip width between each image carrier and an intermediate transfer belt 10 is larger than a nip width between each image carrier and a transfer roller having a voltage applied thereto, and the plurality of transfer rollers are provided.

For example, a bias voltage (e.g., GND to +300v) with which no electric discharge is generated can be applied to the transfer roller 12Y, and a bias voltage (+300 to 2 kv) with which a sufficient transfer electric field can be provided can be applied in the roller 14Y. As a result, the electric discharge on the transfer section inlet side can be suppressed, and the transfer electric field can be gradually applied in a close contact area, thereby improving the transfer performance.

Further, FIG. 4 shows an image forming apparatus having the same configuration as that of FIG. 1 except that three transfer rollers 18Y, 19Y and 22Y having respective power supplies 17Y, 19Y and 21Y connected thereto in the vicinity of a transfer nip are provided in place of the transfer member 5Y having the power supply 7Y connected thereto, three transfer rollers 18M, 19M and 22M having respective power supplies 17M, 19M and 21M connected thereto in the vicinity of the transfer nip are provided in place of the transfer member 5M having the power supply 7M connected thereto, three transfer rollers 18C, 19C and 22C having respective power supplies 17C, 19C and 21C connected thereto in the vicinity of the transfer nip are provided in place of the transfer member 5C having the power supply 7C connected thereto and three transfer rollers 18K, 19K and 22K having respective power supplies 17K, 19K and 21K connected thereto in the vicinity of the transfer nip are provided in place of the transfer member 5K having the power supply 7K connected thereto.

In this apparatus, likewise, a contact nip width between each image carrier and an intermediate transfer belt 10 is larger than a nip width between each image carrier and the transfer roller having a voltage applied thereto, and the plurality of transfer rollers are provided.

For example, a bias voltage with which no electric discharge occurs can be applied to the transfer roller 16Y and the transfer roller 20Y, and an electric field required for the transfer can be applied in the transfer roller 18Y. As a result, the electric discharge on the inlet side and the outlet side of the transfer section can be suppressed, and a transfer electric field can be sufficiently applied in a close contact area, thereby improving the transfer performance.

Furthermore, FIG. 5 shows an image forming apparatus having the same structure as that of FIG. 1 except that three transfer rollers 18M, 19M and 22M having respective power supplies 17M, 19M and 21M connected thereto in the vicinity of a transfer nip are provided in place of the transfer member 5M having the power supply 7M connected thereto and three transfer rollers 18C, 19C and 22C having respective power supplies 17C, 19C and 21C connected thereto in the vicinity of the transfer nip are provided in place of the transfer member 5C having the power supply 7C connected thereto.

In this apparatus, likewise, a contact nip width between each image carrier and an intermediate transfer belt 10 is larger than a nip width between each image carrier and a transfer roller having a voltage applied thereto, and the plurality of transfer rollers are provided. Moreover, a configuration of a transfer section provided to face a first image forming station and a third image forming station is the same as that shown in FIG. 2, and a configuration of a transfer section provided to face a second image forming station and the third image forming station is the same as that depicted in FIG. 4.

In this apparatus, likewise, the contact nip width between each image carrier and the intermediate transfer belt 10 is larger than the nip width between each image carrier and the transfer roller having a voltage applied thereto, and the plurality of transfer rollers are provided.

The transfer section using three transfer rollers has the transfer efficiency better than that of the transfer section using a single transfer roller, and it hardly generates the reverse transfer. However, the transfer section using three transfer rollers complicates the apparatus and increases the cost. Therefore, the plurality of transfer rollers can be provided to at least one image forming station of the image forming stations provided on the rear stage of the first image forming station. For example, in the image forming apparatus shown in FIG. 5, three transfer rollers can be applied to the second image forming station and the third image forming station in which a mixed color is apt to be generated, and an inexpensive single transfer roller can be used in the first image forming station in which no mixed color is generated and the fourth image forming station in which a mixed color is indistinctive even if such a mixed color is generated. Additionally, since the excessive electric discharge mainly tends to occur at an inlet where the photoreceptor comes into contact with the intermediate transfer body, there can be considered a countermeasure, e.g., winding the intermediate transfer body around the photoreceptor to widen a close contact area and then setting an electric field on the upstream side of the nip to be small.

Image formation was performed by using the same samples as Samples 1 to 10 by utilizing the image forming apparatuses shown in FIGS. 3 to 5. As a result, evaluations of occurrence of image irregularities were the same as those shown in Table 1, but levels at which image irregularities were generated are as follows.

In these modifications of the transfer member, an air gap is apt to be generated when the carrier is intervened, and an increase in local reverse transfer and occurrence of image irregularities caused due to this increase are problems. However, when such transfer members are applied to the image forming apparatus according to the present invention, excellent image formation is enabled without such problems.

Example of Image Formation with Toner Layer Thickness Changed

Adhesion of the carrier is not the only factor of an adhesion defect, and this adhesion defect may be possibly produced by a step alone between a part where a toner image exists and a part where no toner image exists on the intermediate transfer body, for example. Further, as compared with the interposition of the carrier between the image carrier and the transfer medium, a step due to a toner image can be always produced.

Thus, image formation was performed while changing a solid toner layer thickness in each image forming station, and image irregularities due to local abnormal electric discharge were observed.

Table 4 shows a thickness of the toner layer in each image forming station and a state of occurrence of image irregularities due to abnormal electric discharge in each image forming station.

TABLE 4

| | | Image irregularities | | | |
|---|---|---|---|---|---|
| | Solid toner film thickness of each station | First image forming station | Second image forming station | Third image forming station | Fourth image forming station |
| Condition 1 | 15 μm | ○ | ○ | Δ | X |
| Condition 2 | 12 μm | ○ | ○ | ○ | X |
| Condition 3 | 10 μm | ○ | ○ | ○ | Δ |
| Condition 4 | 8 μm | ○ | ○ | ○ | ○ |

It is to be noted that, in this table, ○ indicates no occurrence of the local concentration irregularities, Δ indicates occurrence of slight irregularities and × indicates occurrence of considerable concentration irregularities.

For example, in case of Condition 1, a toner layer thickness when the yellow toner is transferred onto the intermediate transfer body is 15 μm in the first image forming station. When the magenta toner having a thickness of 15 μm is likewise overlapped in the second image forming station, a toner layer thickness becomes 30 μm. Image irregularities were not generated at this point in time. Further, when the cyan toner having a thickness of 15 μm is overlapped in the third image forming station, a total thickness becomes 45 μm. Here, image irregularities were slightly generated. Furthermore, a toner layer thickness becomes 60 μm in the fourth image forming station. The abnormal electric discharge occurs due to this step, and image irregularities were generated by the reverse transfer.

As described above, it was revealed from Table 4 that the local abnormal electric discharge occurs and irregularities are apt to be produced in an image when the step generated due to presence/absence of the toner becomes approximately 30 μm or above like the particle diameter of the carrier particles. That is, the abnormal electric discharge can be avoided by setting the step produced by overlapping the color toners to 30 μm or below. For example, when image forming stations for four colors are provided, it is possible to set a total toner layer thickness of the first to third colors to be not greater than 30 μm.

A toner layer thickness and a state of a mixed color were checked as follows.

In a test pattern, a printing ratio of a first transfer image having a yellow color in the first image forming station was determined as 45% of the total in an isolated-dot form corresponding to 30 dpi. Moreover, the yellow toner was also provided in the developing device of the second image forming station, and a second transfer image was superimposed on the first transfer image at a printing ratio of 45%. Additionally, in the third image forming station, the cyan toner was used, a printing ratio was determined as 5%, and a third transfer image was printed in such a manner that this image cannot be superimposed on the first transfer image of the yellow color. Such a test pattern was printed on 1000 paper sheets. A color difference fluctuation between a cyan image on the initial stage and a cyan image after printing the test pattern on 1000 paper sheets was measured by using X-Rite 500 manufactured by Nihon Heiban Kizai Kabushiki Kaisha. Likewise, a toner thickness of the first transfer image and a toner thickness of the second transfer image were changed at the same ratio, and a color difference fluctuation was likewise measured.

Figure 6:
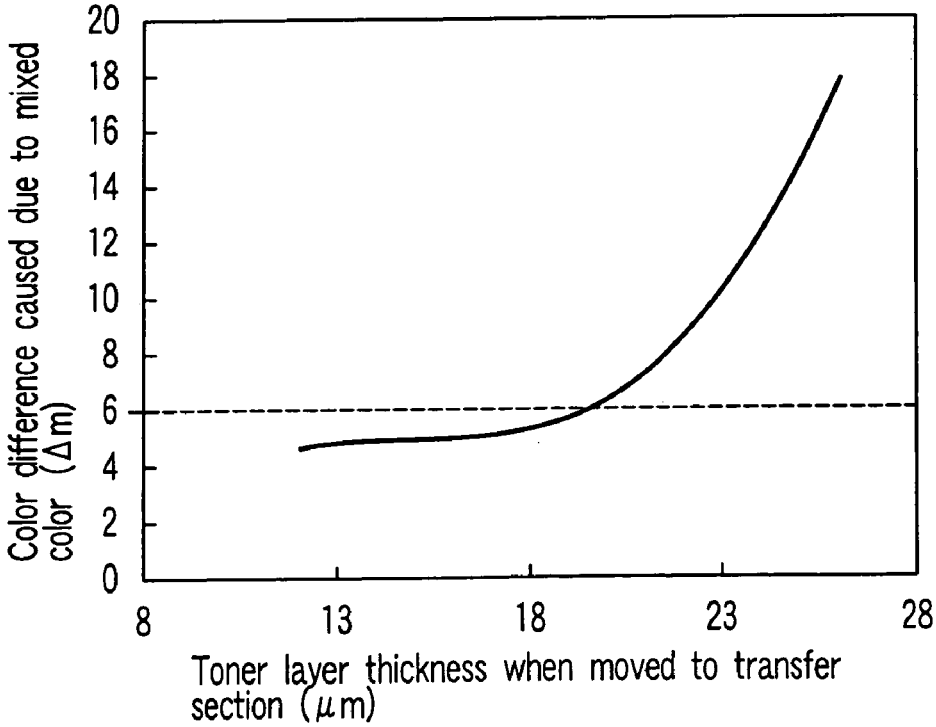
FIG. 6 is a graph showing a relationship between a toner layer thickness of a transferred image and a color difference fluctuation.

FIG. 6 is a graph showing a relationship between a total toner layer thickness of the first and second transfer images and a color difference fluctuation.

As shown in the drawing, when a total toner layer thickness of the first and second transfer images exceeds 20 μm, a color difference is rapidly deteriorated. In general, when the yellow color is mixed in the cyan color, it is determined that a color difference which seems abnormal exceeds $\Delta E=6$ to 8. Based on this, it is preferable that a total thickness of the transfer images of the first image forming station and the second image forming station is not greater than 20 μm. Additionally, although the transfer is carried out with the largest toner layer thickness in the fourth station, the fourth station has the black color in most cases, and an influence of a mixed color can be hardly seen. That is, when the fourth station has the black color, the total toner layer thickness in the first and second stations is important. In this case, if a station having a color other than black is adopted as the fourth station, it is preferable that the total toner layer thickness of the first, second and third stations is not greater than 20 μm.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus configured to form a color image comprising: a plurality of image forming stations each comprising an image carrier, a developing device which is provided on the image carrier, retains a developing agent containing a toner and a carrier and forms a toner image on the image carrier, and a mechanism which collects the toner remaining on the image carrier after toner image transfer by the developing device; and a toner image transfer section which transfers the toner image onto a transfer medium, wherein a ratio of the number of carrier particles having a particle diameter which is not less than 40 μm is not greater than 5% of a total number of the carrier particles, and a ratio of the number of carrier particles having a particle diameter which is not less than 30 μm is not greater than 20% of the total number of the carrier particles.

2. The image forming apparatus according to claim 1, wherein, in at least one image forming station of image stations provided on a rear stage of a first image forming station, a contact nip width between the transfer medium and the image carrier is larger than a nip width between the transfer medium and a transfer member having a voltage applied thereto.

3. The image forming apparatus according to claim 2, wherein the toner image transfer section is provided in accordance with each of the plurality of image stations, and a plurality of transfer members are provided in at least one image forming station of image stations provided on the rear stage of the first image forming stations.

4. The image forming apparatus according to claim 1, wherein the transfer medium is an intermediate transfer body, and a color image transfer section which finally transfers the color image formed on the intermediate transfer body onto a recording member is further provided.

5. The image forming apparatus according to claim 4, wherein the intermediate transfer body has a laminated structure including at least two layers, and the hardness of an outermost layer which is in contact with the image carrier is lower than that of at least one of the other layers.

6. The image forming apparatus according to claim 1, wherein the plurality of image forming stations comprises first to third image forming stations and have a relationship expressed as $T1+T2+T3<30$ μm, where T1 μm is a thickness of the toner which is formed in the first image forming station and transferred onto the transfer medium, T2 μm is a thickness of the toner which is formed in the second image forming station and transferred onto the transfer medium and T3 μm is a thickness of the toner which is formed in the third image forming station and transferred onto the transfer medium.

7. The image forming apparatus according to claim 6, further comprising a fourth image forming station provided with a black toner, wherein a total toner layer thickness of solid images of the first image forming station and the second image forming station is not greater than 20 μm.

8. An image forming apparatus comprising: a plurality of image forming stations each comprising an image carrier, a developing device which is provided on the image carrier, retains a developing agent containing a toner and a carrier and forms a toner image on the image carrier, and a mechanism which collects the toner remaining on the image carrier after toner image transfer by the developing device; a toner image transfer section which transfers the toner image onto an intermediate transfer body; and a color image transfer section provided on a rear stage of the plurality of image stations, wherein the intermediate transfer body has a laminated structure including at least two layers, and the hardness of an outermost layer which is in contact with the image carrier is lower than that of at least one of the other layers, and wherein a ratio of the number of carrier particles having a particle diameter of $40+T5/2$ μm or above with respect to the entire carrier particles is not greater than 5%, and a ratio of the number of carrier particles having a particle diameter of $30+T5/2$ μm or above with respect to the entire carrier particles is not greater than 10%, where T5 μm is a thickness of the outermost layer.

9. The image forming apparatus according to claim 8, wherein the carrier has a particle size distribution in which a ratio of the number of carrier particles having a particle diameter which is not smaller than 40 μm is not greater than 5% of the total number of the carrier particles, and a ratio of the number of carrier particles having a particle diameter which is not smaller than 30 μm is not greater than 20% of the total number of the carrier particles.

10. The image forming station according to claim 8, wherein, in at least one image forming station of image stations provided on a rear stage of a first image forming station, a contact nip width between the transfer medium and the image carrier is larger than a nip width between the transfer medium and a transfer member having a voltage applied thereto.

11. The image forming apparatus according to claim 8, wherein the toner image transfer section is provided in accordance with each of the plurality of image stations, and a plurality of transfer members are provided to at least one image forming station of the image stations provided on the rear stage of the first image forming stations.

12. The image forming station according to claim 8, wherein the plurality of image forming stations comprise first to third image forming stations and have a relationship expressed as $T1+T2+T3<30$ μm, where T1 μm is a thickness of the toner which is formed in the first image forming station and transferred onto the transfer medium, T2 μm is a thickness of the toner which is formed in the second image forming station and transferred onto the transfer medium, and T3 μm is a thickness of the toner which is formed in the third image forming station and transferred onto the transfer medium.

13. The image forming station according to claim 8, further comprising a fourth image forming station provided with a black toner, wherein a total toner layer thickness of solid images of the first image forming station and the second image forming station is not greater than 20 μm.

14. An image forming apparatus comprising: first to third image forming stations each comprising an image carrier, a developing device which is provided on the image carrier, retains a developing agent containing a toner and a carrier and forms a toner image on the image carrier, and a mechanism which collects the toner remaining on the image carrier after toner image transfer by the developing device; and a toner image transfer section which transfers the toner image onto a transfer medium, wherein the image forming apparatus has a relationship expressed as $T1+T2+T3<30$ μm, where T1 μm is a thickness of the toner which is formed in the first image forming station and transferred onto the transfer medium, T2 μm is a thickness of the toner which is formed in the second image forming station and transferred onto the transfer medium, and T3 μm is a thickness of the toner which is formed in the third image forming station and transferred onto the transfer medium.

15. The image forming apparatus according to claim 14, further comprising a fourth image forming station provided with a black toner, wherein a total toner layer thickness of solid images of the first image forming station and the second image forming station is not greater than 20 μm.

16. The image forming apparatus according to claim 14, wherein, in at least one image forming station of image stations provided on a rear stage of the first image station, a contact nip width between the transfer medium and the image carrier is larger than a nip width between the transfer medium and a transfer member having a voltage applied thereto.

17. The image forming apparatus according to claim 14, wherein the toner image transfer section is provided in accordance with each of the plurality of image stations, and a plurality of transfer members are provided to at least one image forming station of the image stations provided on the rear stage of the first image forming station.

18. The image forming apparatus according to claim 14, wherein the carrier has a particle size distribution in which a ratio of the number of carrier particles having a particle diameter which is not smaller than 40 μm is not greater than 5% of a total number of the carrier particles, and a ratio of the number of carrier particles having a particle diameter which is not smaller than 30 μm is not greater than 20% of the total number of the carrier particles.

19. The image forming apparatus according to claim 14, wherein the transfer medium is an intermediate transfer body, and a color image transfer section which finally transfers the color image formed on the intermediate transfer body onto a recording member.

20. The image forming apparatus according to claim 19, wherein the intermediate transfer body has a laminated structure including at least two layers, and the hardness of an outermost layer which is in contact with the image carrier is lower than that of at least one of the other layers.

* * * * *